US005119134A

United States Patent [19]

Haneda et al.

[11] Patent Number: 5,119,134

[45] Date of Patent: Jun. 2, 1992

[54] PHOTOSENSITIVE MEMBER PROTECTION SHUTTER FOR USE IN A COLOR IMAGE FORMING APPARATUS

[75] Inventors: Satoshi Haneda; Masakazu Fukuchi; Shunji Matsuo; Shizuo Morita, all of Hachioji, Japan

[73] Assignee: Konica Corporation, Tokyo, Japan

[21] Appl. No.: 581,477

[22] Filed: Sep. 11, 1990

[30] Foreign Application Priority Data

Sep. 26, 1989 [JP] Japan ..... 1-251381
Oct. 18, 1989 [JP] Japan ..... 1-270817

[51] Int. Cl.[5] ..... G03G 5/00

[52] U.S. Cl. ..... 355/212; 346/160.1; 355/200; 355/210; 355/326

[58] Field of Search ..... 355/200, 210, 211, 212, 355/326, 327; 346/160.1

[56] References Cited

U.S. PATENT DOCUMENTS

| | | | |
|---|---|---|---|
| 4,588,280 | 5/1986 | Ogawa et al. | 355/200 |
| 4,796,037 | 1/1989 | Takada et al. | 346/160.1 |
| 4,829,334 | 5/1989 | Takamatsu et al. | 355/211 X |
| 4,839,692 | 6/1989 | Shoji et al. | 355/211 |
| 4,937,635 | 6/1990 | Paxon et al. | 355/326 |
| 5,063,411 | 11/1991 | Haneda et al. | 355/212 |
| 5,065,195 | 11/1991 | Haneda et al. | 355/210 X |

FOREIGN PATENT DOCUMENTS

| | | |
|---|---|---|
| 59-34546 | 2/1984 | Japan . |
| 59-61860 | 4/1984 | Japan . |
| 59-61865 | 4/1984 | Japan . |
| 60-75850 | 4/1985 | Japan . |
| 60-76766 | 5/1985 | Japan . |
| 60-95456 | 5/1985 | Japan . |
| 60-95458 | 5/1985 | Japan . |
| 60-158475 | 8/1985 | Japan . |
| 61-100770 | 5/1986 | Japan . |
| 61-129678 | 6/1986 | Japan . |
| 61-149972 | 7/1986 | Japan . |

*Primary Examiner*—A. T. Grimley
*Assistant Examiner*—J. E. Barlow, Jr.
*Attorney, Agent, or Firm*—Frishauf, Holtz, Goodman & Woodward

[57] ABSTRACT

A color image forming apparatus wherein a belt-shaped image retainer faces an image forming device. The image forming device includes a charging device, exposure device and a plurality of developing devices which are juxtaposed with each other. The belt-shaped image retainer is in the form of a cartridge which is mounted removably in the apparatus body. The cartridge has a closable cover divided into several sections which are arranged at the positions facing the image device. The belt-shaped image retainer has a transversely movable shutter member for protecting spaced apart surface portions of the image retainer which would be otherwise exposed when the upper casing of the apparatus body is opened or when the image retainer is removed from the upper casing, by moving the shutter member transversely to cover the spaced apart exposed surface portions of the image retainer.

14 Claims, 10 Drawing Sheets

PHOTOSENSITIVE MEMBER PROTECTION SHUTTER FOR USE IN A COLOR IMAGE FORMING APPARATUS

BACKGROUND OF THE INVENTION

1. Field of the Invention

This invention relates to a color image forming apparatus adapted to form a toner image on a belt-shaped image retainer by an electrophotographic system, to transfer the toner image on a transfer material and to obtain an object image.

2. Description of the Prior Art

Many methods and apparatuses for obtaining color images by using electrophotography have been proposed. As disclosed in, for example, Japanese Patent Laid-open No. 100770/1986, there is a method of obtaining a color copy by forming a latent image on a photosensitive drum serving as an image retainer in accordance with a color separation number of a document image, developing the latent image on the drum, transferring the resultant image onto a transfer drum every time the development of the latent image is completed to form a multi-color image on the transfer drum, and thereafter transferring the multi-color image onto a transfer material to obtain an object color copy. An apparatus realizing this method needs to be provided with a large transfer drum where a one-frame image is transferred on the circumferential surface in addition to a photosensitive drum. Consequently, it is unavoidable that this apparatus has a large and complicated structure.

There is another method disclosed in, for example, Japanese Patent Laid-open No. 149972/1986, which comprises the steps of forming a latent image on a photosensitive drum in accordance with the color separation number of a document image, developing the latent image on the drum, and transferring the resultant image onto a transfer material every time the development of the latent image is completed, to obtain a multi-color copy. In this method, it is difficult to accurately superpose each of monochromatic images upon one another, so that a high-quality multi-color copy cannot be obtained.

There is also another method of obtaining a color image, which comprises the steps of repeating formation of a latent image on a photosensitive drum in accordance with the color separation number of a document image and development of the latent image with color toners, superposing color toner images upon one another on the photosensitive drum, and then transferring the resultant image onto a transfer material. The basic processes for formation of such a multi-color image are disclosed, for example, in Japanese Patent Laid-open Nos. 75850/1985, 76766/1985, 95456/1985, 95458/1985 and 158475/1985.

In a multi-color image forming apparatus for obtaining a color image by such an image superposing step, a plurality of developing devices storing different color toners therein are arranged around a photosensitive drum, and a latent image on this drum is developed by rotating the same drum generally a plurality of times to obtain a color image.

In addition to the photosensitive drum which has a photoconductive material applied or evaporated on the circumferential surface of the drum as described above, a belt-shaped image retainer which has a photoconductive material applied or attached to a flexible belt has also been proposed.

In Japanese Patent Laid-open No. 129678/1986, for example, there is proposed a monochromatic laser printer utilizing a belt-shaped image retainer. In this printer, the shape of the belt-shaped image retainer is determined by training the image retainer around rollers including a drive roller. Thus, the printer is advantageous in that it can be constructed in a compact form by utilizing the space efficiently. Further, the printer is of a clamshell structure with the belt-shaped image retainer being constructed as a unit adapted to be inserted removably in the printer body. Accordingly, it is easy to correct jamming or to replace parts. In the printer of the prior art, however, no measures are adopted to protect the image retainer against damage which would be caused when the clamshell is opened or when the unit is inserted or removed.

Further, since the belt-shaped image retainer can be moved along a line of small curvature, a roller with a small diameter can be used so that imperfect separation of transfer material is prevented by utilizing the part with the curvature for separating the transfer material.

Some of the image forming apparatuses are adapted such that the inside of the apparatus is opened or a process unit of cartridge type is removed from the apparatus body for the purpose of correcting jamming and replacing or cleaning components. If the apparatus is opened or the components are removed in this manner, the exposed components are apt to be damaged or contaminated with dust. For solving such, it has also been proposed to provide a protective cover. For example, Japanese Patent Laid-Open No. 34546/1984 proposes a protective cover for protecting an exposure section, Japanese Patent Laid-open No. 61865/1984 proposes a protective cover for protecting a photosensitive body of a transfer section and Japanese Patent Laid-open No. 61860/1984 proposes a protective cover for protecting a developing section.

Further, in the copier industry, there is an increasing demand for color images in place of monochromatic images because the color images can carry more data than the monochromatic ones.

In order to meet such demand, a color copying machine utilizing the belt-shaped image retainer as described above, the Sharp Full Color Copying Machine CX-7500, for example, has been developed and is available on the market. This color copying machine is of analogue mode and comprises a machine body including a paper feeding system and an upper casing adapted to be openable with respect to the machine body, a belt-shaped image retainer, a plurality of developing devices juxtaposed over the image retainer and an electric control system. The color copying machine is adapted to form toner images of respective colors sequentially on the belt-shaped image retainer by rotating the image retainer several times, while each toner image formed on the image retainer is transferred to a transfer belt. As a result, the toner images of the respective colors are superposed on the transfer belt to provide a color toner image. This color toner image is transferred onto a transfer paper and fixed to form a color image.

However, in the conventional color copying machine as described above, the upper casing which is adapted to be openable with respect to the machine body contains many components including the belt-shaped image retainer, several developing devices, analogue control system etc., and it is so heavy that it is difficult to open.

In addition, since no measures are adopted for protecting the surface of the image retainer exposed to the outside when the upper casing is opened, the copying machine encounters problems because the image retainer is apt to be subjected to fatigue deterioration due to light and it is apt to be damaged or contaminated with dust.

Further, since the conventional copying machine employs an image forming method in which the toner images of the respective colors formed on the image retainer by several rotations of the image retainer are superposed on the intermediate transfer belt, accuracy of superposition is very low and the color image can not be obtained with high resolution.

In order to solve the problem of protection of the exposed surface of the image retainer, various measures have been proposed by Japanese Patent Laid-open No. 34546/1984, No. 61865/1984 and No. 61860/1984, for example. All this prior art, however, relates to a reproducing machine adapted to form monochromatic images in an analogue mode by utilizing an image forming drum.

Methods of forming color images have been proposed in Japanese Patent Laid open Nos. 75850/1985 and 76766/1985, for example, wherein toner images of respective colors are superposed on an image retainer to form color toner images and the color toner images are transferred collectively onto a transfer paper and fixed thereon to form a color image. According to such method, the color image can be obtained without color misregistration and with high resolution since the toner images of the respective colors are superposed directly on the image retainer. However, both of these prior art apparatuses utilize an image forming drum for image formation and do not disclose any measures for protecting the surface of the image forming drum.

Further, in the color image forming apparatus utilizing the belt-shaped image retainer as described above, the image forming means including charging means, image exposure means and a plurality of developing devices are juxtaposed mainly on the lower part of the outer periphery of said belt-shaped image retainer. Accordingly, if the belt-shaped image retainer takes the form of a removable cartridge, a wide range of a photosensitive material opposite to the image forming means will be exposed and the risk of damaging the image retainer becomes very high.

SUMMARY OF THE INVENTION

An object of the invention is to provide a color image forming apparatus having a removable belt-shaped image retainer and adapted such that the removed image retainer itself can be protected effectively.

Said object is attained by a color image forming apparatus comprising a belt-shaped image retainer trained around a plurality of rollers and image forming means consisting of charging means, exposure means and a plurality of developing devices which are juxtaposed with each other at positions facing the belt-shaped image retainer, the apparatus being characterized in that said belt-shaped image retainer constitutes a cartridge removably mounted in the apparatus body and having a closable cover divided into several sections placed at the positions facing said image forming means.

Another object of the present invention is to provide a color image forming apparatus having an upper casing openable with respect to the apparatus body, and a unit including a belt-shaped image retainer adapted to be inserted removably in the upper casing, wherein a surface of said belt-shaped image retainer which is exposed when said upper casing is opened or said unit is removed can be protected effectively so that color images of high quality can be supplied stably.

Said object is attained by a color image forming apparatus comprising a belt-shaped image retainer trained around a plurality of rollers and image forming means provided on the periphery of the image retainer, said images forming means including charging means, exposure means and a plurality of developing devices juxtaposed with each other, and said image forming apparatus further comprising an apparatus body and an upper casing adapted to be openable with respect to the apparatus body, wherein said belt-shaped image retainer is constructed as a unit which can be inserted removably in said upper casing, said unit having a shutter member adapted to protect a surface of belt-shaped image retainer which is exposed when said upper casing is opened or when said unit is removed from the upper casing by moving transversely to cover the exposed surface of the image retainer.

Other objects and features of the present invention will be apparent from the following description taken in connection with the accompanying drawings.

DESCRIPTION OF PREFERRED EMBODIMENTS

An embodiment of a color image forming apparatus according to the present invention is shown in FIGS. 1 through 6.

Figure 1:
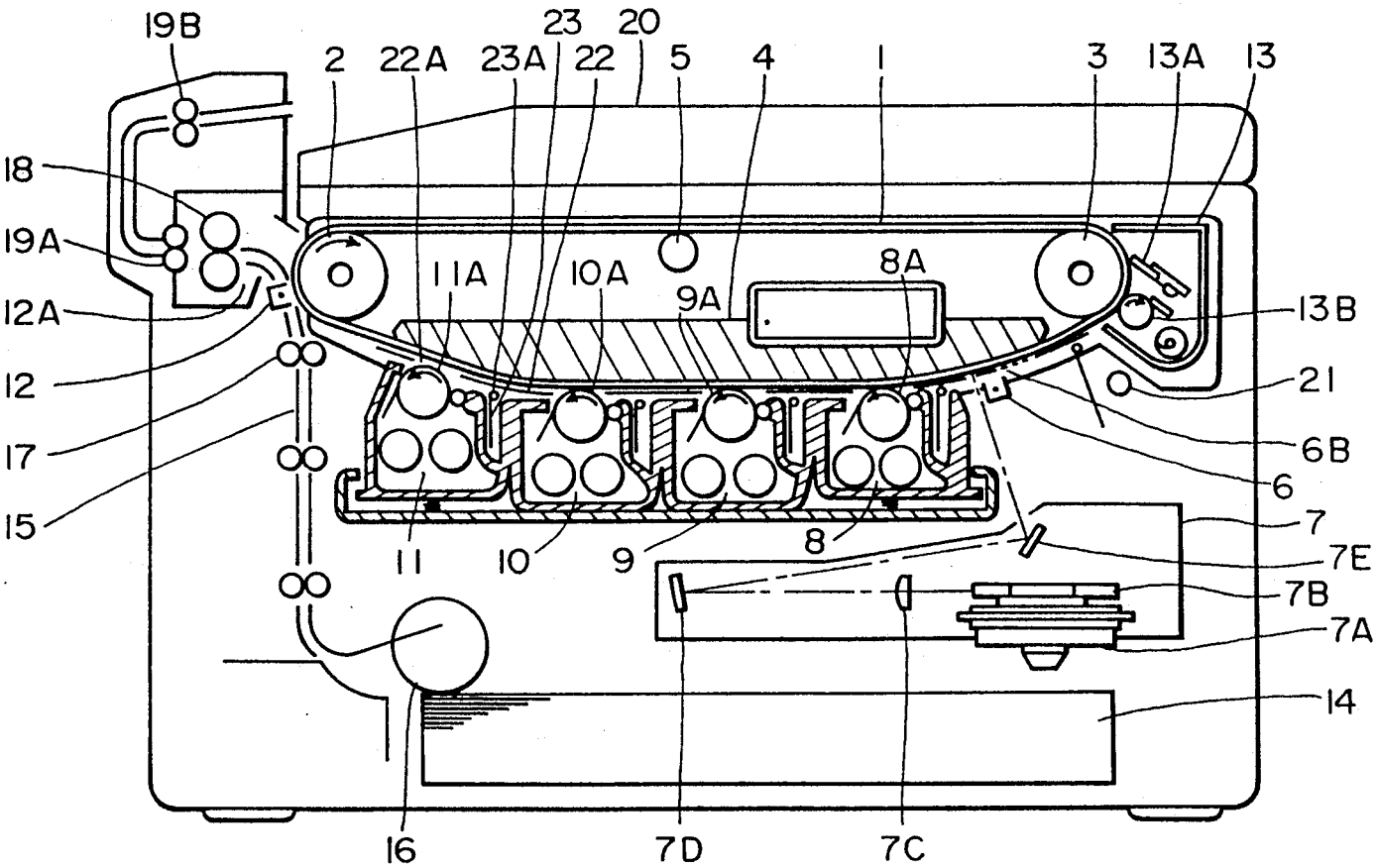
FIGS. 1, 3 and 6 are cross sections of a color image forming apparatus according to the present invention.

Referring to FIG. 1, reference numeral 1 denotes a flexible photosensitive belt constituting a belt-shaped image retainer, which is trained around rollers 2, 3 and turned clockwise by the driving force of the roller 2.

Reference numeral 4 denotes a guide member inscribing the photosensitive belt 1, which is tensed by an operation of an outwardly biased tension roller 5 to be brought slidably into contact at the inner circumferential surface thereof with the guide member 4.

Accordingly, the photosensitive material on the outer circumferential surface of the photosensitive belt 1 can always keep a constant positional relation with respect to the surface of the guide member 4 even while the photosensitive belt 1 is turned, so that a stable image forming surface can be obtained.

Reference numeral 6 denotes a scorotron charger, a charging means, 7 a laser writing unit, an image exposing means, and 8 to 11 a plurality of developing devices, i.e. developing means containing developers a predetermined color. These developing means are arranged facing the photosensitive belt 1.

In addition to the optical system shown in the drawings the laser writing unit 7 includes an optical system of a unitary combination of a light emitting element and a convergent light transmission member.

The developing devices 8, 9, 10 and 11 contain, for example, yellow, magenta, cyan and black developers respectively, and are provided with developing sleeves 8A, 9A, 10A and 11A which retain predetermined clearances between the developing devices and photosensitive belt 1, the developing devices having the function of turning a latent image on the photosensitive belt 1 into a visible image by a non-contact reversal developing method. This non-contact developing method is different from contact developing methods and has an advantage in that the movement of the photosensitive belt 1 is not interfered with.

Reference numeral 12 denotes a transfer device, 12A a charge eliminating bar, and 13 a cleaning device as a cleaning means. A blade 13A and a toner feeding roller 13B in this cleaning device are retained in the positions apart from the surface of the photosensitive belt 1 during the formation of an image, and they are pressed against the surface of the photosensitive belt 1, as shown in the drawing, only while a cleaning operation is carried out after the completion of the transferring of the image.

A color image recording process performed by this color image forming apparatus is carried out as follows.

Figure 2:
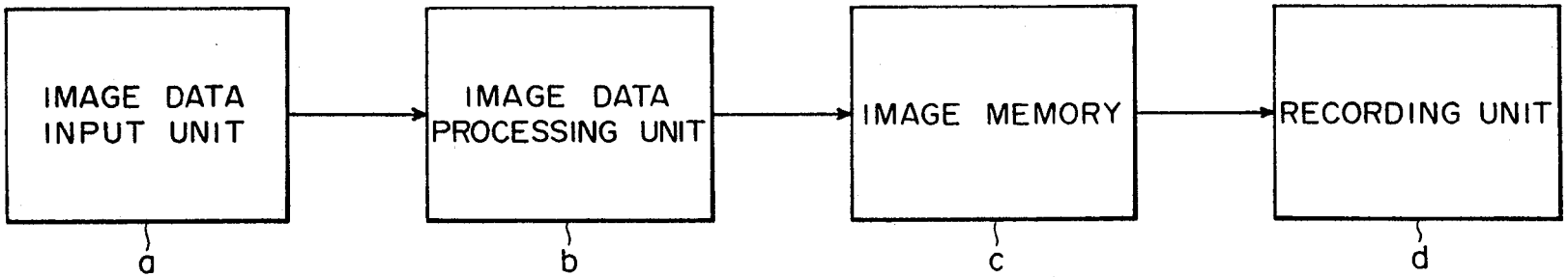
FIG. 2 is a block diagram showing an image forming system.

The formation of a multi-color image by this embodiment is carried out in accordance with an image formation system shown in FIG. 2. Namely, the data obtained in a color image data input unit a in which an original image is scanned by an image pickup element are computed in an image data processing unit b having a calculating function, and image data is stored temporarily in an image memory c. The image data are then taken out in a recording step and inputted into, for example, the color image forming apparatus serving as a recording unit d of the embodiment of FIG. 1.

When a color signal outputted from an image reading apparatus provided independent of the color image forming apparatus is inputted into the laser writing unit 7, a laser beam emitted from a semiconductor laser (not shown) is caused to rotationally scan by a polygon mirror 7B therein which is turned by a driving motor 7A, and the optical path of the laser beam is then bent by mirrors 7D, 7E via a $f\phi$ lens 7C, the laser beam being thereafter projected on the circumferential surface of the photosensitive belt 1 which has been charged by the charging device 6 provided as a charging means to form a latent image.

When the scanning is started, the laser beam is detected by an index sensor, and the modulation of the laser beam in accordance with a first color signal is started, the circumferential surface of the photosensitive belt 1 being scanned with the modulated laser beam. Thus, a latent image corresponding to a first color is formed on the circumferential surface of the photosensitive belt 1 by the primary scanning with the laser beam and the auxiliary scanning based on the movement of the photosensitive belt 1. This latent image is developed by the developing device 8 containing a yellow toner, among the developing means in this apparatus, to form a yellow toner image on the circumferential surface of the photosensitive belt 1. The toner image thus obtained passes under the cleaning unit 13 placed apart from the circumferential surface of the photosensitive belt 1, as the image is left on the same belt 1, to enter a subsequent copying cycle.

The photosensitive belt 1 is charged again by the charging device 6, and a second color signal outputted from the signal processor is then inputted into the writing unit 7, the writing on the circumferential surface of the photosensitive belt 1 being done in the same manner as in the case of the writing based on the first color signal, to form a latent image. This latent image is developed by the developing device 9 containing a magenta toner as a second color, to be turned into a magenta toner image superposed on the already-formed yellow toner image.

Reference numeral 10 denotes a developing device containing a cyan toner with which a cyan toner image is formed on the previously-mentioned toner images on the circumferential surface of the photosensitive belt 1 on the basis of an image signal generated in the signal processor.

Reference numeral 11 denotes a developing device containing a black toner, with which a black toner image is superposed on the already-formed toner images on the circumferential surface of the photosensitive belt 1 by the same process as mentioned above. DC or AC bias voltage devices 8, 9, 10 and 11, and a jumping developing process is carried out with a developing means. i.e. a one-component or two-component developer, whereby the non-contact reversal development is carried out on the photosensitive belt 1 the base body of which is grounded.

The color toner image thus formed on the circumferential surface of the photosensitive belt 1 is transferred in the transfer unit onto the transfer paper fed through a paper feed guide 15 from a paper feed cassette 14.

The ordinary transfer paper stored in the paper feed cassette 14 is sent out piece by piece in accordance with the rotation of the paper feed roller 16 toward the transfer unit 12 via timing rollers 17 in synchronism with the image forming on the photosensitive belt 1.

The transfer paper which has been subjected to the transferring of an image and the elimination of charge is separated reliably from the photosensitive belt 1, the direction of movement of which is suddenly changed along the roller 2, to advance upward without being influenced, owing to the charge eliminating effect. The image is then fixed by the fixing rollers 18, and thereafter, the transfer paper is moved onto the ejection tray 20 via the paper ejection rollers 19A and 19B.

The photosensitive belt 1 from which the toner image has been transferred onto the transfer paper is fed continuously. The toner remaining in said cleaning device 13 of which the blade 13A and the toner feeding roller 13B are in a press contact state is removed and then the blade 13A is separated. Shortly after, the toner piled on the tip end of the blade 13A is leveled by a toner feeding roller 13B, and then the toner feeding roller 13B is separated to enter into a new image forming process.

The color image forming apparatus has a clamshell structure in which the upper casing can be opened by rotating it clockwise around a rotation axis 21. The upper casing contains said photosensitive belt 1 and the cleaning device 13, while the lower casing contains the developing devices, the laser writing unit 7 and the fixing rollers 18 together with the paper feed cassette 14.

Said scorotron charger 6 comprises a discharge electrode device 6A and a grid 6B which are contained separately by the upper casing and the lower casing, respectively. Said electrode device 6A is combined with the grid 6B to constitute the charger 6 when the upper casing is closed.

Said grid 6B is supported by said guide member 4 while it is attached to a protective plate 22 totally covering the lower face of the photosensitive belt 1 serving as an image forming face.

The protecting plate 22 has square holes 22A formed in the parts thereof corresponding to the developing sleeves and the exposure sections of the developing devices so that the protective plate 22 covers and protects the photosensitive belt 1 except its image processing sections.

The guide member 4 is provided with five protective covers 23 in total for covering said square holes 22A and the grid 6B. When the upper casing is closed, the protective covers 23 are rotated around respective support shafts 23A to be opened approximately at a right angle, as seen from the example of the developing device 11 in FIG. 1. Among the protective covers 23 thus opened, those for covering the square holes 22A corresponding to the developing sleeves are received in spaces provided in the housing of the developing devices.

When said protective covers 23 are opened as a result of closing of the upper casing, the photosensitive belt 1 is enabled to be charged by the charger 6, the laser writing unit 7 is enabled to expose the image and the developing sleeves of the developing devices are enabled to develop the latent images. Thus, the apparatus is ready to start the process of forming a color image.

Figure 3:
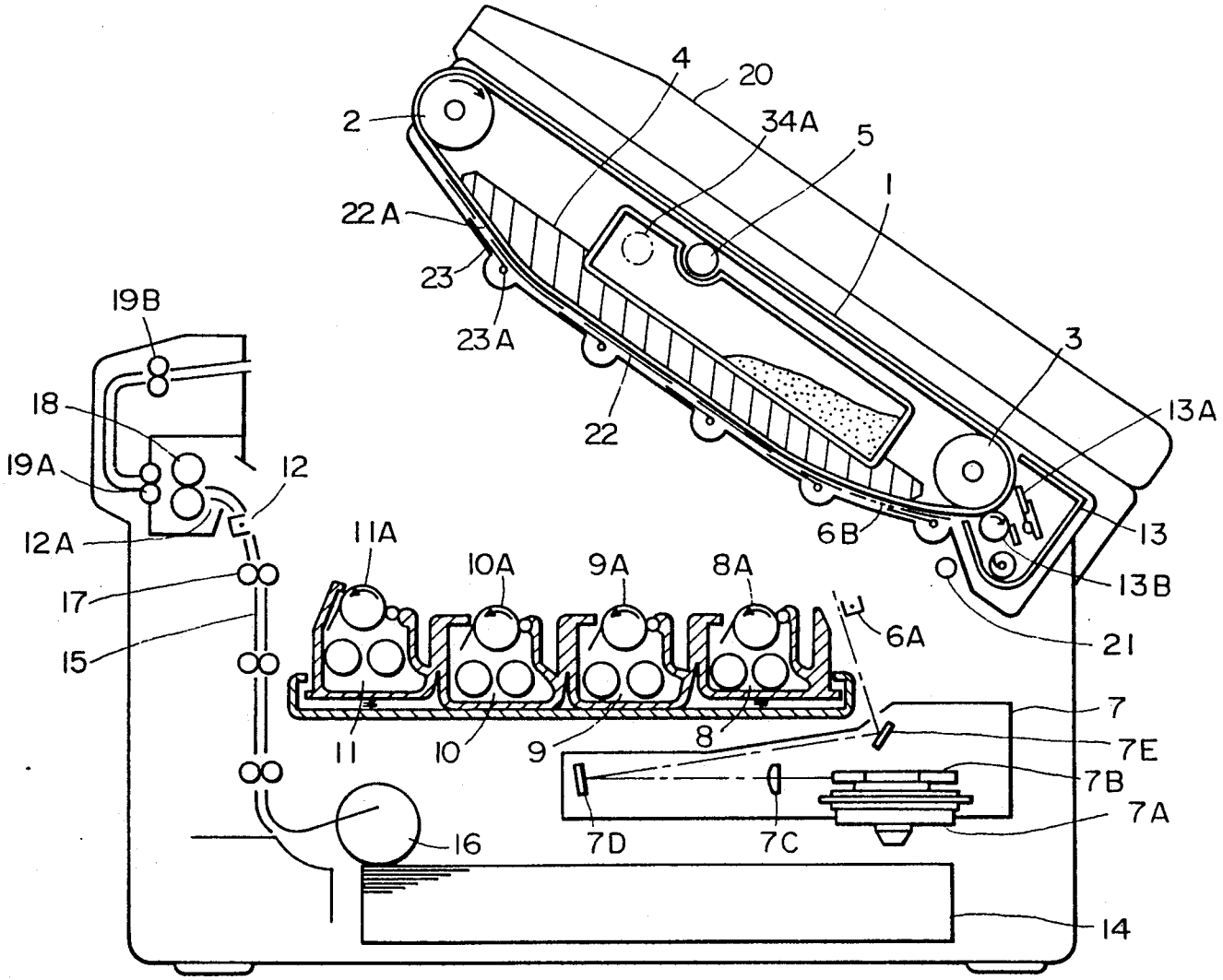

When the upper casing is opened, on the contrary, the protective covers 23 are rotated clockwise around the support shafts 23A to close said square holes 22A and to cover the photosensitive face of the photosensitive belt 1 for protecting the same, as shown in FIG. 3.

Figure 4:
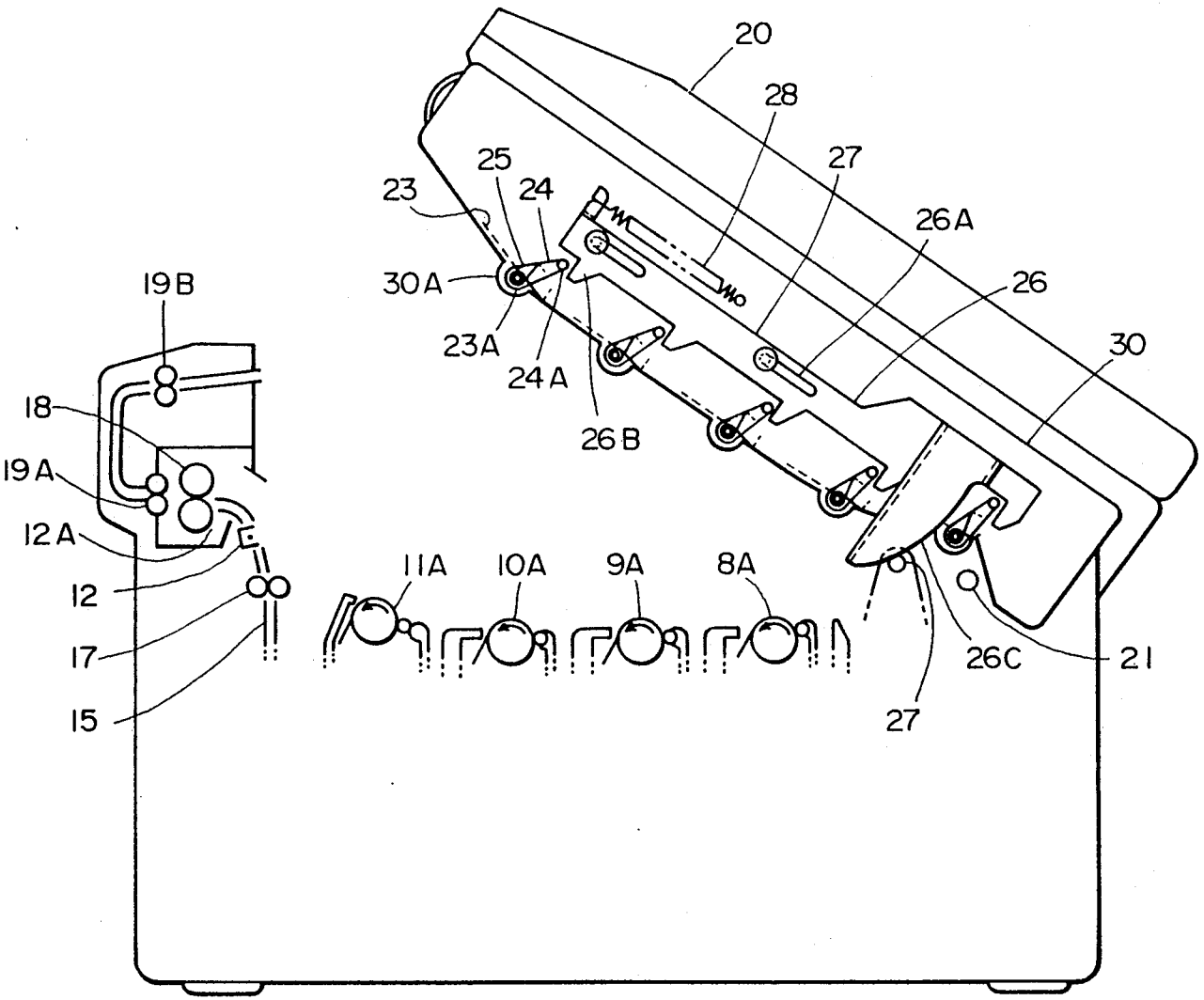
FIGS. 4, 5(A) and 5(B) are explanatory representations showing a change-over mechanism of protective covers.
Figure 5:
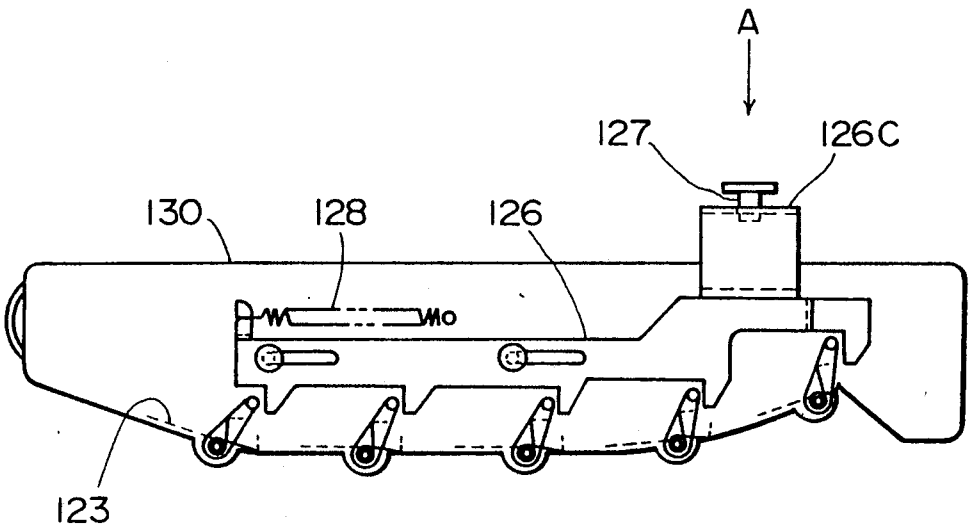
Figure 5:
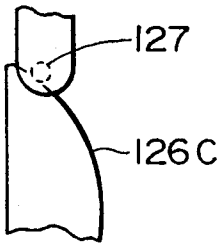

FIG. 4 shows a change-over mechanism of the protective covers 23, which is actuated by opening or closing the upper casing.

The photosensitive belt 1, the guide member 4 and the cleaning device 13 are incorporated in a process cartridge 30 and are supported by the upper casing as a unit. The support shafts 23A of the protective covers 23 are also journaled by side plates 30A provided in front of and project the process cartridge 30.

The support shafts 23A project to the front of the side plates 30A and an arm 24 having a driving pin 24A attached to the end is secured integrally to each of the projection parts of the support shafts 23A. The arm 24 is biased normally clockwise by a return spring 25 whereby the square holes 22A are closed by the protective covers 23. Such an arm 24 is provided for all of the five protective covers 23 described in the above.

A driving plate 26 is attached to the central part of the side plate 30A while supported thereby through a pair of guide shafts 27 for guiding a pair of slots 26A, such that the driving plate 26 is slidable only transversely.

The driving plate 26 has teeth 26B formed at the positions corresponding to the driving pins 24A of the arms 24 while spaced by a small distance from the driving pins 24A. The driving plate 26 further has a cam face 26C on its step part.

When the upper casing is open, a pressure pin 29 fixed to the lower casing does not press said cam face 26C and the driving plate 26 is in the free state. Accordingly, the driving plate 26 is held in the rightmost position by a tension spring 28 provided between the driving plate 26 and the side plate 30A and, at this position, the guide shafts 27 are locked at the lefthand ends of the slots 26A.

Consequently, the driving pins 24A are disengaged from the teeth 26B of the driving plate 26 to make the protecting covers 23 freely movable and to let said protecting covers close the square holes 22A by action of the return springs 25.

When the upper casing is rotated anticlockwise around the rotation axis 21 for closing the same, the cam face 26C of the driving plate 26 is pressed by the pressure pin 29 and the driving plate 26 is slid left-ward against action of the tension spring 28, whereby the teeth 26B are pressed against the corresponding driving pins 24A and the arms 24 are rotated counter-clockwise.

Accordingly, the protecting covers 23 are also rotated counter-clockwise against action of the respective return springs 25 and they are opened approximately at a right angle as shown in FIG. 1 when the upper casing is closed completely.

In the embodiment as described hereinabove, the protective covers themselves are changed over by closing and opening of the upper casing. The protecting covers may be adapted such that they are normally opened independently of closing or opening of the upper casing and are closed only when the process cartridge 30 is removed by drawing it out from the front of the upper casing.

FIGS. 5(A) and 5(B) show an example adopting such an arrangement. As shown in FIG. 5(A), a part of a driving plate 126 is bent at a right angle and extended in parallel with the top face of a process cartridge 130 to define a cam face 126C extended along the depth of the plate as seen from FIG. 5(B) showing the cam face as viewed in the direction indicated by the arrow A. The cam face 126C is adapted to be pressed by a pressure pin 127 when a process cartridge 130 is mounted in the upper casing.

Accordingly, when the process cartridge 130 is inserted in the upper casing, the cam face 126C is always pressed by the pressure pin 127 and the driving plate 126 is slid to and held at the leftmost position and protective covers 123 are opened. These conditions are maintained independent of the closing or opening of the upper casing.

When the process cartridge 130 is drawn out of the upper casing, the cam face 126C is disengaged from the pressure pin 127 which has been pressed against the cam face, and, thereby, the driving plate 126 is returned to the rightmost position as shown in FIG. 5(A) by action of a tension spring 128. As a result, the protective covers 123 are automatically caused to cover the photosensitive face.

Figure 6:
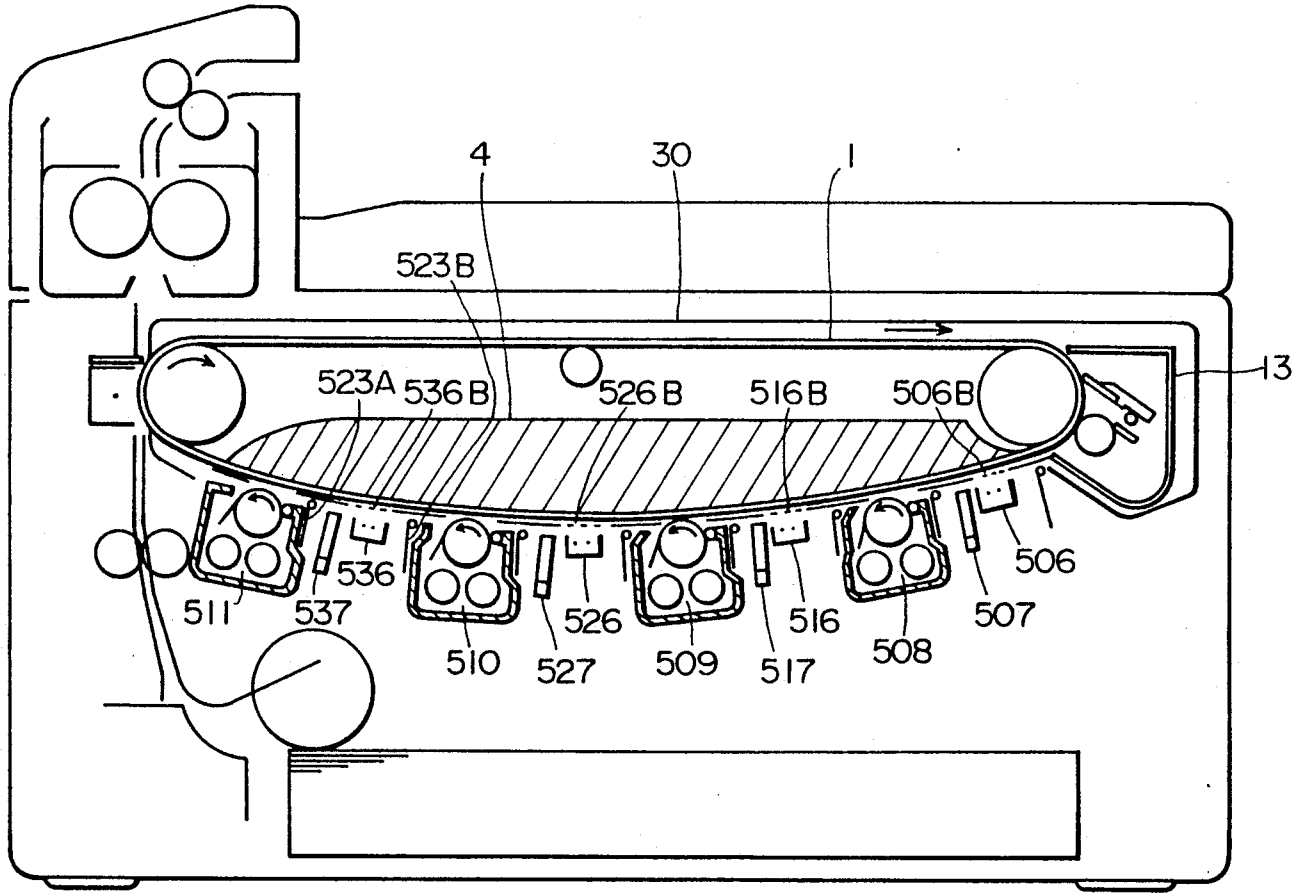

The present invention is applicable to any color image forming apparatus utilizing a photosensitive belt, regardless of the image forming system it adopts. For example, the present invention is applicable, for the purpose of protecting the photosensitive face, to a color image forming apparatus as shown in FIG. 6 having a color image forming system wherein chargers 506, 516, 526, 536 and exposure devices 507, 517, 527, 537 are provided for developing devices 508 through 511, respectively, so that formation and transfer of a color image can be finished by one transfer cycle of a photosensitive belt 501.

Also in this embodiment, grids 506B, 516B, 526B, 536B of the chargers are mounted on the lower casing and a pair of protective covers are provided in each developing device. Referring to the developing device 511 for example, a pair of protective covers 523A and 523B are provided for covering the grid 536B and a square hole of the developing sleeve opposing thereto, separately.

In the color image forming apparatus utilizing the photosensitive face of the photosensitive belt or the scorotron chargers according to the invention, the surface of the grid can be protected safely against contamination or damage which would often be caused during operation or maintenance of the apparatus. As a result, it is possible according to the invention to realize an image forming apparatus which is economical because the photosensitive belt and the grid are allowed to have prolonged lifetime, and which provides images of high quality because the photosensitive body can always be kept in optimum condition.

FIGS. 7(A) to 7(D), FIG. 8 and FIG. 9 illustrate another embodiment of the present invention.

Figure 7A:
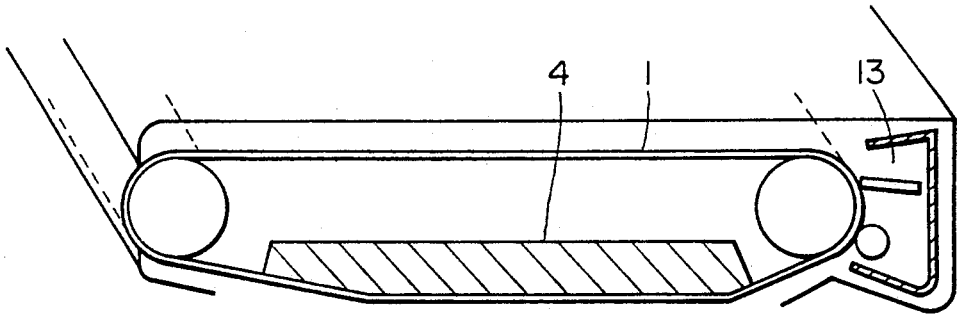
FIGS. 7(A) to 7(D) are perspective views illustrating arrangement of a protective plate and a shutter member according to another embodiment of the present invention.
Figure 7B:
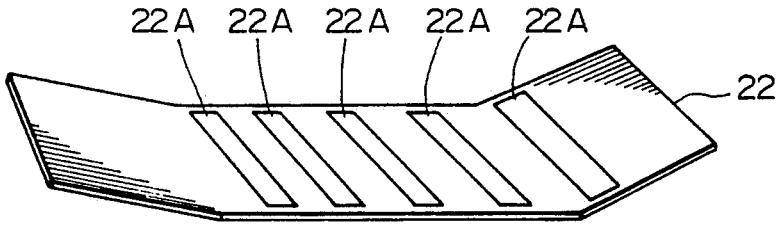
Figure 7C:
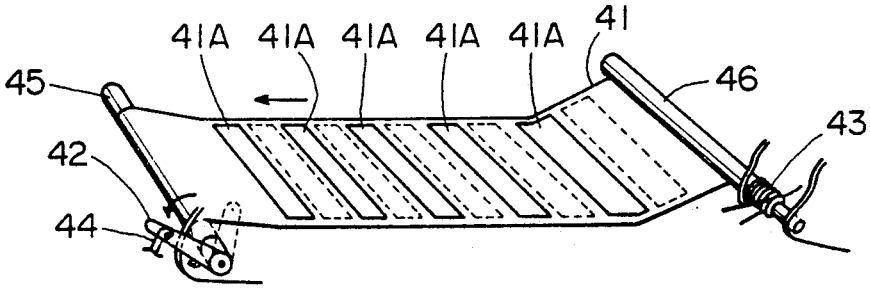
Figure 7D:
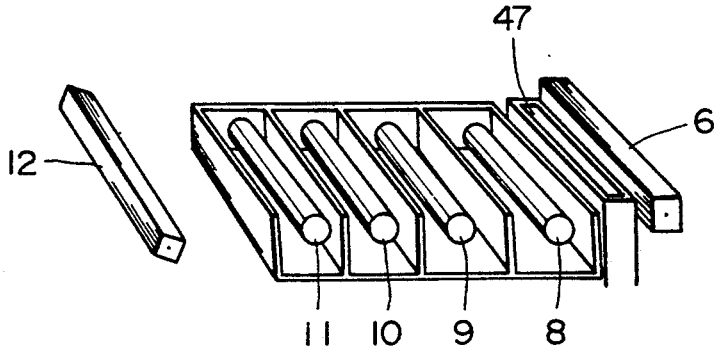

In this embodiment, the square holes 22A of the protecting plate 22 are opened or closed by transversely moving a shutter member 41 which is mounted in the same unit and provided with openings 41A having a size equal to that of the square holes 22A and formed at the positions corresponding to the square holes 22A, as shown in FIG. 7(C).

The shutter member 41 is capable of closing or opening the multiplicity of square holes 22A in the protective plate 22 simultaneously by moving slightly along the surface of the protective plate 22. Consequently, the shutter member 41 can protect a multiplicity of exposed surfaces present over a wide range or the image retainer 1 by means of a simple mechanism.

More particularly, when the upper casing is opened or the image retainer unit is removed, the shutter member 41 incorporated in the unit is moved, as shown in FIG. 7C, in the direction indicated by the arrow to the position of the stopper against tension force of a rewinding spring 43, by rotation of a rewinding handle 42. The shutter member 41 is then locked at that position by a locking member 44. In this case, the openings 41A of the shutter member 41 are moved from the positions indicated by the broken lines to the positions indicated by the solid lines, whereby all the square holes 22A of the protecting plate 22 are closed by the shutter member 41. When the upper casing is closed and the unit is inserted the shutter member 41 which has been locked as described in the above is unlocked and returned to the reference position (indicated by the broken line) by tension of the rewinding spring 43, whereby the openings 41A of the shutter member 41 are brought to the positions corresponding to the square holes 22A of the protective plate 22. Thus, the apparatus is enabled to form the image. In the drawings, reference numeral 45 denotes a winding roller for winding the shutter member 41, 46 denotes a rewinding roller and 47 denotes an exposure opening.

Preferably, the shutter member 41 is operated either manually by rotating the rewinding handle 42 or mechanically is association with opening and closing of the upper casing.

In addition to the manual and automatic mechanical means described above, the shutter member 41 also may be operated by a driving motor or driving solenoid. Since the shutter member 41 is moved close to the surface of the developing roller when the shutter member 41 is operated, it is apt to be contaminated with a developer. Accordingly, the shutter member 41 should be moved transversely only while the upper casing is apart from the apparatus body and should not be moved when the upper casing is in close contact with the apparatus body. For this reason, in the case of manual operation, it is very important to time the operation properly.

According to the arrangement described above, the exposed surface of the belt-shaped image retainer 1 can be covered and protected when it is removed from the apparatus body. Thus, fatigue deterioration, damage or contamination with dust of the image retainer 1 can be prevented effectively and the image forming apparatus is allowed to supply images of high quality stably and for a prolonged period of time.

The developing devices mounted in the lower casing are juxtaposed on the lower face of the belt-shaped image retainer 1 with their developing faces facing upwards. Preferably, the developing devices have a part of their walls in common with each other so that they are united into one body which can be removably inserted into the apparatus body. According to such arrangement, it is possible to minimize contamination or mixing of the toners among the developing devices and, further, the apparatus as a whole can be settled stably because the center of gravity of the apparatus becomes relatively low.

Figure 8:
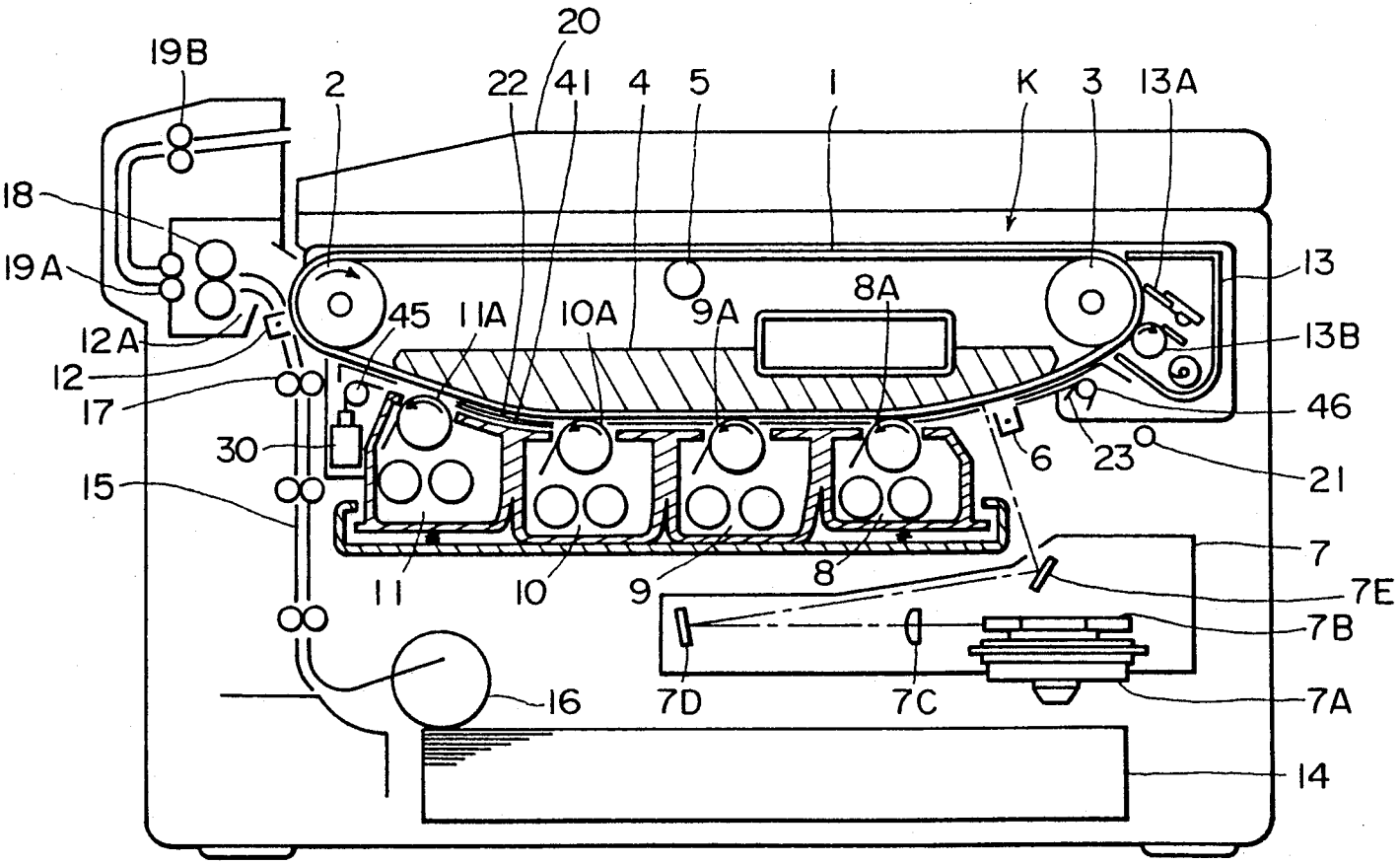
FIGS. 8 and 9 are cross sections of a color printer utilizing said shutter member.
Figure 9:
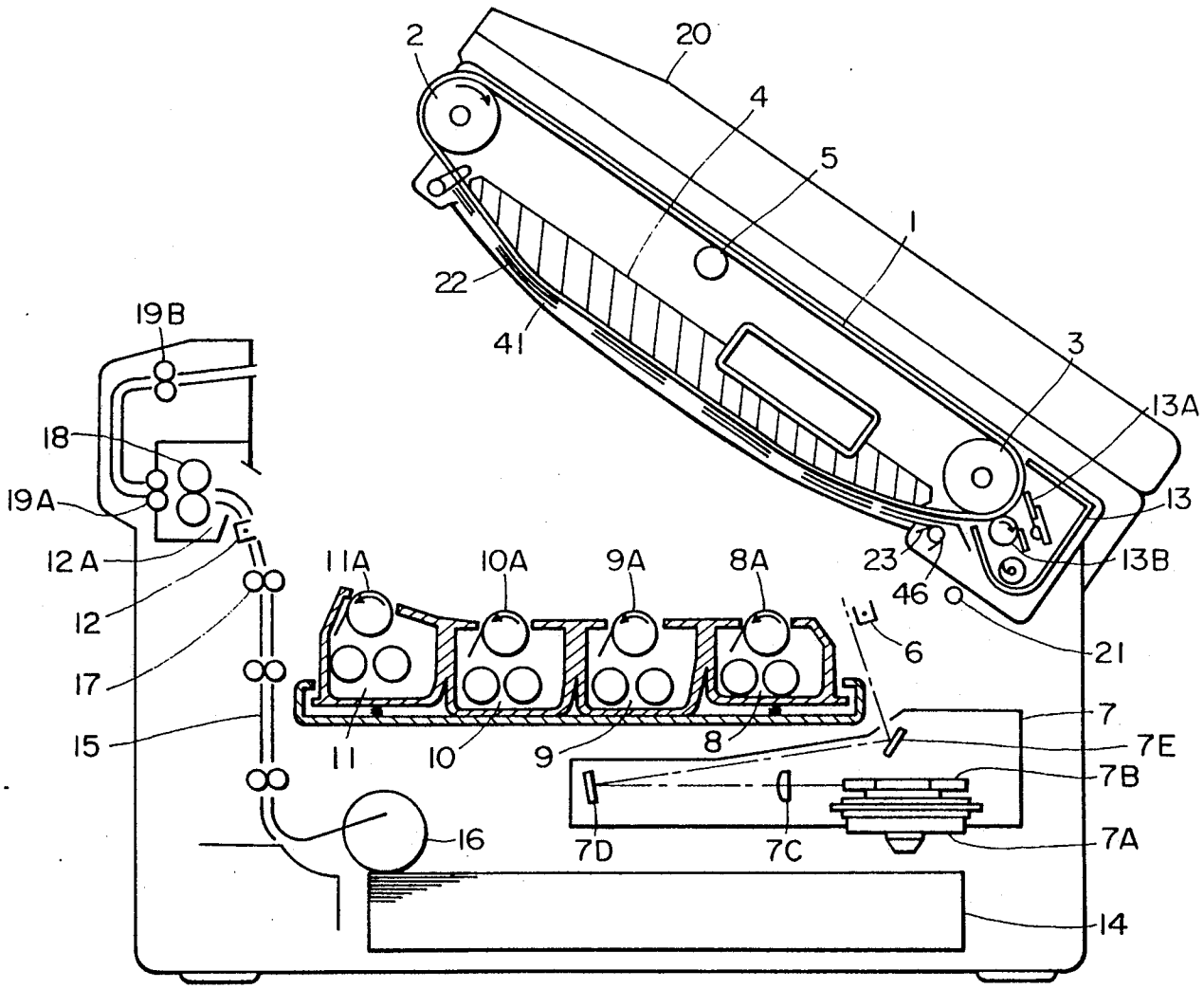
Figure 10:
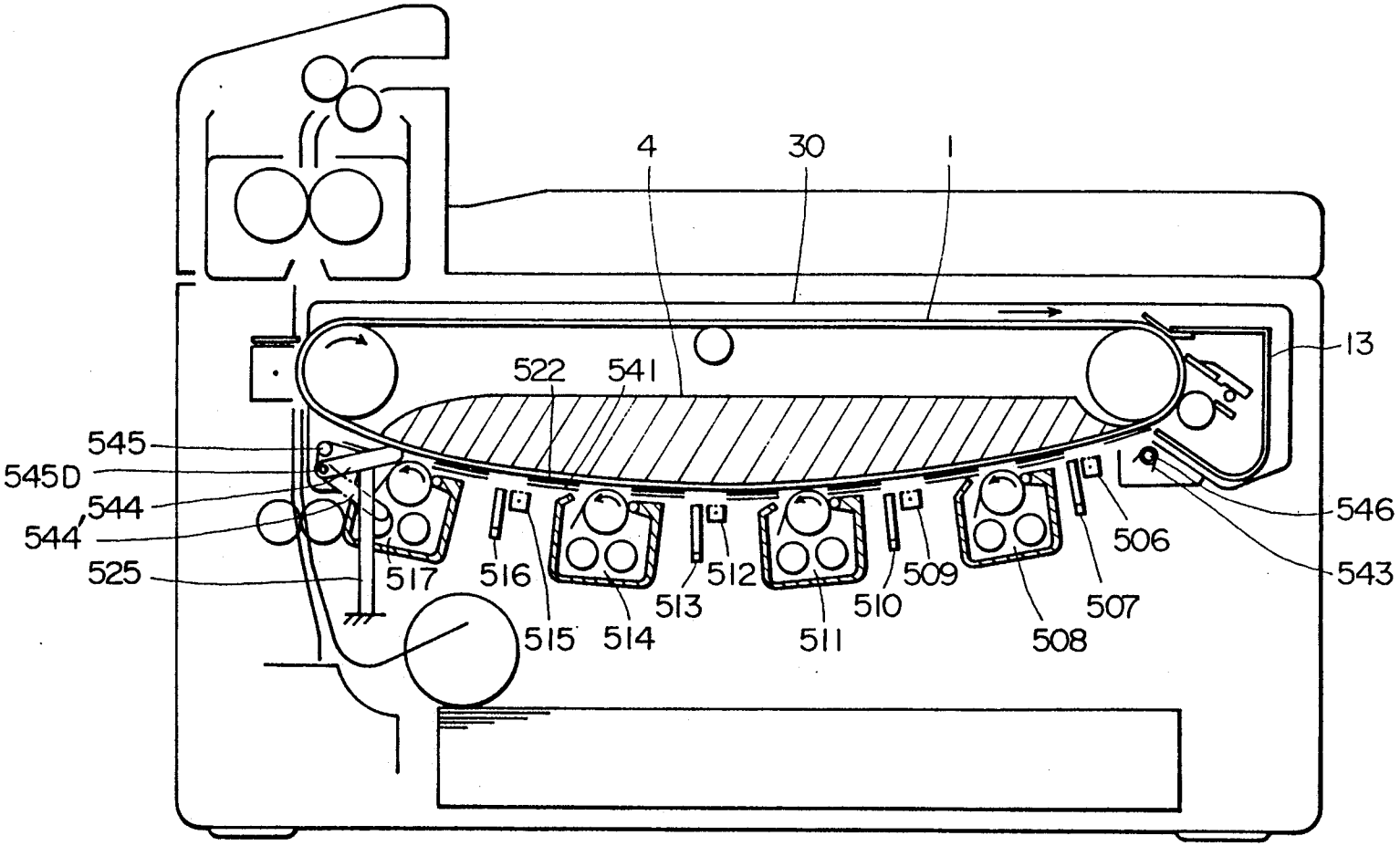
FIG. 10 is a cross section showing still another embodiment of the present invention.

FIG. 10 shows a modification of the embodiment of FIG. 8. The modification of FIG. 10 is different from the embodiment of FIG. 8 in the following facts:

(1) Y, M, C and BK developing devices 508, 511, 514 and 517 mounted below the lower face of the photosensitive belt 1 are provided with chargers 506, 509, 512 and 515 and LED exposure devices 507, 510, 513 and 516, respectively, so that toner images of four colors consisting of Y, M, C and BK are superposed on an image 1 by one rotation of the image retainer. The toner images of four colors are transferred onto a transfer paper collectively and fixed to provide a color image.

(2) For this purpose, a protecting plate 522 and a shutter member 541 arranged below the lower face of the photosensitive belt are provided with eight openings in total, four openings at the positions corresponding to the developing devices and four openings at the positions corresponding to the four sets of dischargers and exposure devices. These openings are arranged approximately at regular intervals.

(3) When the upper casing is closed, a locking member 544 fixed to a roller shaft 545D of a winding roller 545 is operated by a projection 525 on the apparatus body and thereby pushed up to the upper position. Therefore, the shutter member 541 is moved to the lefthand side as viewed on the drawing and the image forming faces of the image retainer including the charging, exposing and developing faces are opened. Thus, the apparatus is ready to form an image.

When the upper casing is opened, a rewinding roller 546 is operated to rewind the shutter member 541 by tension of a spring 543, whereby the shutter member 541 is moved to the righthand side as viewed on the drawing while moving the locking member 544 to the position of 544'. Thus, the image forming faces of the image retainer are covered by the shutter member 541.

Except for the differences as mentioned in (1) to (3) above, the modification of the FIG. 10 has similar construction to that of FIG. 8. External color signals of Y, M, C and BK modulate lights from the exposure devices 507, 510, 513 and 516 and a color toner image is formed from the modulated lights of the respective colors by one rotation of the image retainer. The color toner image is fixed by a hot roller to provide a color image in a similar manner to the embodiment described in the above.

Protection of the image retainer is ensured, similarly to the above embodiment, by operation of the protective plate 522 and the shutter member 541. It has been found that the apparatus can repeatedly form a color image in a stable manner without fatigue deterioration.

According to the embodiments of the color image forming apparatus as described hereinabove, several parts of the surface of the image retainer exposed when the upper casing is opened or when the image retainer unit is removed can be protected effectively by operation of the shutter member having simple construction and, hence, fatigue deterioration of the image retainer can be prevented and improved durability in repeated uses can be ensured.

What is claimed is:

1. A color image forming apparatus having an apparatus body with an openable upper casing, the image forming apparatus comprising:

an image retainer unit removably insertable in said openable upper casing, said image retainer unit including a rotatable image retainer; and image forming means mounted in said apparatus body and comprising charging means, exposure means, and a plurality of developing devices facing said image retainer at respective spaced apart positions;

said removably insertable image retainer unit further including:

a protecting means having a plurality of spaced apart openings at positions facing said plurality of developing devices, said protecting means protecting said image retainer at positions other than said spaced apart positions where said image retainer faces said plurality of developing devices, protecting covers movable to open or close said plurality of spaced apart openings of said protecting means, and a driving member for moving all of said protecting covers at the same time to close said plurality of spaced apart openings when said openable upper casing is opened, and for opening said plurality of spaced apart openings when said openable upper casing is closed, said protecting covers thereby protecting and covering spaced apart surface portions of said image retainer which face said plurality of developing devices at said spaced apart positions and which would be otherwise exposed when said openable upper casing is opened.

2. A color image forming apparatus according to claim 1, wherein said plurality of developing devices correspond to respective different color images.

3. A color image forming apparatus according to claim 2, wherein said image forming means is arranged to operate a plurality of times to form a color toner image by superposing toner images of different colors corresponding to said plurality of developing devices on said image retainer, a color toner image being transferred in one step from said image retainer to a transfer material.

4. A color image forming apparatus according to claim 1, wherein said image retainer comprises a belt-shaped image retainer trained around a plurality of rollers.

5. A color image forming apparatus according to claim 4, wherein said plurality of developing devices are disposed below said belt-shaped image retainer.

6. A color image forming apparatus according to claim 1, wherein said exposure means includes electrical signal means for modulating light.

7. A color image forming apparatus having an apparatus body with an openable upper casing, the image forming apparatus comprising:

an image retainer unit removably insertable in said openable upper casing, said image retainer unit including a rotatable image retainer; and image forming means mounted in said apparatus body and comprising charging means, exposure means, and a plurality of developing devices facing said image retainer at respective spaced apart positions;

said removably insertable image retainer unit further including:

a protecting means having a plurality of spaced apart openings at positions facing said plurality of developing devices, said protecting means protecting said image retainer at positions other than said spaced apart positions where said image retainer faces said plurality of developing devices, protecting covers movable to open or close said plurality of spaced apart openings of said protecting means, and a driving member for moving all of said protecting covers at the same time to open said plurality of spaced apart openings when said image retainer unit is inserted into said openable upper casing, and to close said plurality of spaced apart openings when said image retainer unit is removed from said openable upper casing, said protecting covers thereby protecting and covering spaced apart surface portions of said image retainer which face said plurality of developing devices at said spaced apart position and which would be otherwise exposed when said image retainer unit is removed from said openable upper casing.

8. A color image forming apparatus according to claim 7, wherein said plurality of developing devices correspond to respective different color images.

9. A color image forming apparatus according to claim 8, wherein said image forming means is arranged to operate a plurality of times to form a color toner image by superposing toner images of different colors corresponding to said plurality of developing devices on said image retainer, a color toner image being transferred in one step from said image retainer to a transfer material.

10. A color image forming apparatus according to claim 7, wherein said image retainer comprises a belt-shaped image retainer trained around a plurality of rollers.

11. A color image forming apparatus according to claim 10, wherein said plurality of developing devices are disposed below said belt-shaped image retainer.

12. A color image forming apparatus according to claim 7, wherein said exposure means includes electrical signal means for modulating light.

13. A color image forming apparatus having an apparatus body with an openable upper casing, the image forming apparatus comprising:

a belt-shaped image retainer unit removably insertable in said apparatus body, said belt-shaped image retainer unit including a belt-shaped image retainer trained around a plurality of rollers; and image forming means comprising charging means, exposure means, and a plurality of developing devices facing said belt-shaped image retainer at respective spaced apart positions;

said removably insertable belt-shaped image retainer unit further including:

a protecting plate having a plurality of spaced apart openings at respective positions facing said plurality of developing devices, said protecting plate further having means for protecting said belt-shaped image retainer at positions other than said respective spaced apart positions where said belt-shaped image retainer faces said plurality of developing devices, a shutter member, having spaced apart openings and spaced apart solid portions, for selectively covering said spaced apart openings of said protecting plate, and said shutter member being movable by a distance required to open or close said plurality of spaced apart openings of said protecting plate, said solid portions of said shutter member being movable all at the same time for covering said spaced apart openings of said protecting plate for thereby protecting and covering spaced apart surface portions of said belt-shaped image retainer which face said plurality of developing devices at said respective spaced apart positions and which would be otherwise exposed when said openable upper casing is opened or when said belt-shaped image retainer unit is removed from said apparatus body.

14. A color image forming apparatus according to claim 13, wherein:

when said spaced apart openings of said shutter member and said spaced apart opening of said protecting plate are in registration with each other, said plurality of developing devices can form an image on said belt-shaped image retainer; and when said solid portions of said shutter member and said spaced apart openings of said protecting plate are in registration with each other, said belt-shaped image retainer is covered and protected.

* * * * *